United States Patent [19]

Kelly et al.

[11] 4,094,130

[45] June 13, 1978

[54] APPARATUS FOR COMPRESSING AND PACKAGING ARTICLES

[75] Inventors: Norman Kelly; William T. Fletcher, both of Sarnia; Derek J. Holden, Camlachie; James J. Welsh, Sarnia, all of Canada

[73] Assignee: Fiberglas Canada Limited, Toronto, Canada

[21] Appl. No.: 815,356

[22] Filed: Jul. 13, 1977

[30] Foreign Application Priority Data

Apr. 19, 1977 Canada ..... 276433

[51] Int. Cl.[2] ..... B65B 63/02; B65B 13/20

[52] U.S. Cl. ..... 53/124 D; 53/124 TS; 100/215

[58] Field of Search ..... 53/124 D, 124 TS; 100/215, 218

[56] References Cited

U.S. PATENT DOCUMENTS 3,824,759 7/1974 Finn et al. ..... 53/124 D X 3,908,539 9/1975 O'Brien ..... 53/124 D X

*Primary Examiner*—Travis S. McGehee

*Attorney, Agent, or Firm*—Cushman, Darby & Cushman

[57] ABSTRACT

Apparatus for compressing and packaging articles, e.g. insulation batts, comprises a bomb bay door arrangement for receiving the articles in succession and depositing the articles in a first position in successive batches each comprising a stack of the articles, a compression chamber, a movable support for displacing the batches in succession from said first position to a second position in the compression chamber, a lifting fork for displacing a first one of the batches from the second position to a third position in the compression chamber to allow the displacement of the next succeeding batch from the first position to the second position, a vertical ram for compressing the first batch and the next succeeding batch together in the compression chamber, and a horizontal ram for discharging the compressed articles through a bagging snout for applying a bag to the compressed articles.

18 Claims, 14 Drawing Figures

APPARATUS FOR COMPRESSING AND PACKAGING ARTICLES

The present invention relates to apparatus for compressing and packaging articles, and is useful, in particular, for the compression packaging of batts of insulating material.

In order to reduce storage and transportation costs, it is common practice to package insulation batts by firstly compressing them and by then providing them with a covering, for example a bag, which maintains the batts in their compressed state. When the bag is subsequently removed at the point of utilization of the batts, the batts expand to their normal size.

The compression of the insulation batts has hitherto been effected by stacking the batts in a compression chamber provided with a fork for compressing the batts and a piston for discharging the compressed batts from the compression chamber into a bagging apparatus, which usually takes the form of a snout having an outlet end over which the open end of a bag is positioned, so that the compressed batts, forced through the snout by the ram, are thus inserted into the bag.

The insulation batts are delivered to the compression apparatus by an endless conveyor from a production line and, to avoid interruption of the operation of the production line or an accumulation of uncompressed insulation batts, it is necessary to ensure that the insulation batts are promptly handled by the compression apparatus.

Normally, the insulation batts are manually collected from the conveyor belt into batches, each comprising a stack of the batts, and the batches are then manually loaded into the compression chamber.

Consequently, a considerable amount of manual handling of the insulation batts is required, which is uneconomical.

In U.S. Pat. No. 3,824,759, issued July 23, 1974 to Lawrence R. Finn et al, there is proposed a method and apparatus for handling insulation batts which employ a batt compressing and carrying unit comprising robot-unit having forks for successively compressing, adjacent one another, two stacks of batts. The forks are then rotated and linearly displaced to feed the batts into a compression chamber through an open front of the compression chamber. During subsequent withdrawal of the forks from the compression chamber, suction is applied to the batts in the compression chamber through perforations in a back wall of the compression chamber to retain the batts in the compression chamber. A vertical ram is then employed to compress the batts in the compression chamber, and the compressed batts are finally discharged by a horizontal ram from the compression chamber and through an opening into a container.

However, the use of suction to retain the batts in the open-fronted compression chamber during the withdrawal therefrom of the forks is unsatisfactory in practice, since the batts are not securely retained. Moreover, the operation of the robot unit for rotating and linearly displacing the batts is too slow, and consequently this prior apparatus is not able to cope with the continuous delivery of batts from a conveyor at relatively high speeds. In addition, this prior apparatus still requires the presence of at least one operator to collect the batts delivered by the conveyor and to deposit them in stacks on the forks of the compressing and carrying unit. Consequently, this prior proposal likewise requires undesirable and uneconomical manual handling of the insulation batts.

In U.S. Pat. No. 3,117,513, issued Jan. 14, 1964 to D. W. Burnett et al, there is disclosed an insulation batt packaging apparatus comprising an open-topped box serving as a compression chamber, and a conveyor for discharging the batts sequentially through the open top of the box, so that the batts fall downwardly through the box and form a stack of batts on a top plate positioned within the box below the top of the box. The top plate is then laterally withdrawn to deposit the batts on a bottom plate, whereupon the top plate is returned to its position within the box and the bottom plate is raised, so that the batts on the bottom plate are compressed between the bottom plate and the top plate. A horizontally acting ram then discharges the compressed batts from between the top and bottom plate into an ejection chute or snout.

However, this prior apparatus severely and undesirably restricts the number of batts which can be compressed together at one time for discharge by the ram since, if the height of the box is increased in order to allow a larger number of batts to be compressed at a time between the top and bottom plates, then the batts are required to fall through a considerable and undesirably large distance through the box. Consequently, there would be a danger that the falling batts would not fall correctly into a proper stack, but would become jammed within the box.

It is accordingly an object of the present invention to provide a novel and improved apparatus for compressing and packaging articles which, while entirely eliminating manual handling of the articles, enables a larger number of the articles to be included in one package.

According to the present invention, there is provided apparatus for compressing and packaging articles, comprising means for receiving the articles in succession and depositing the articles in a first position in successive batches each comprising a stack of the articles, a compression chamber, means for displacing the batches in succession from the first position to a second position in the compression chamber, means for displacing a first one of the batches from the second position to a third position in the compression chamber to allow the displacement of the next succeeding batch from the first position to the second position, means for compressing the first batch and the next succeeding batch together in the compression chamber, and means for applying a covering to the compressed batches.

Preferably, the receiving means comprise a pair of retainer members pivotable about parallel horizontal axes between closed positions, in which the retainers support the articles thereon, and open positions, in which the retainers are spaces sufficiently to allow the articles to fall therebetween under gravity to the first position.

The invention will be more readily understood from the following description of a preferred embodiment thereof given, by way of example, with reference to the accompanying drawings, in which.

Figure 1:
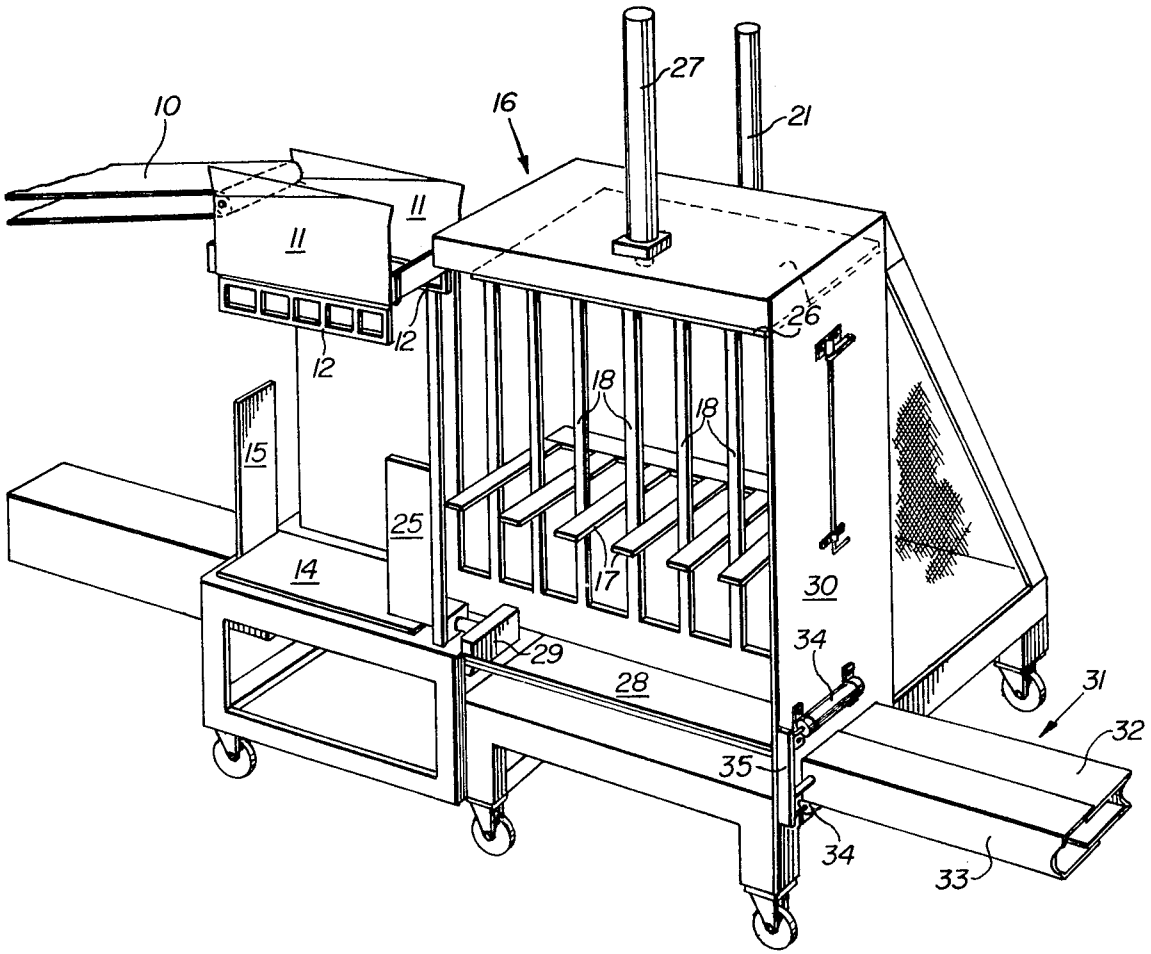
FIG. 1 shows a view in perspective of an insulation batt compressing and packaging apparatus.
Figure 2:
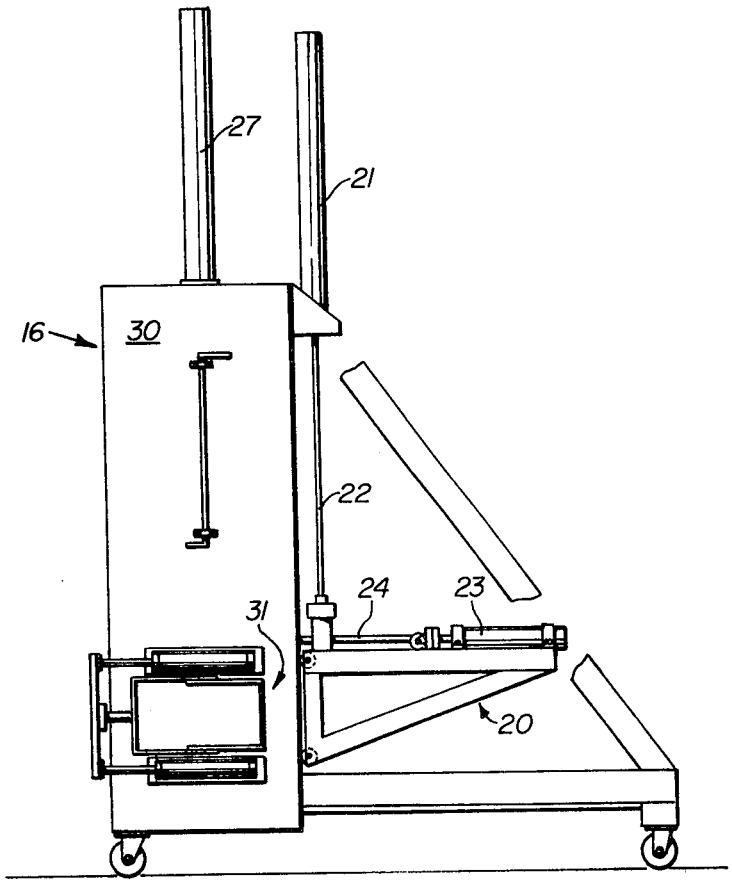
FIG. 2 shows a view taken in end elevation of the apparatus of FIG. 1.

The insulation batt compressing and packaging apparatus illustrated in FIGS. 1 and 2 is adapted to receive insulation batts carried in succession to the apparatus on an upwardly inclined endless belt conveyor 10. At the uppermost portion of the inclined conveyor 10, the apparatus has a batt receiving arrangement comprising a pair of spaced parallel, generally vertical walls 11 between which the batts are discharged from the conveyor 10. Beneath the walls 11, there are provided a pair of bomb bay doors 12, which are pivotable about parallel horizontal axes and which serve to temporarily retain the insulation batts thereon when the doors 12 are pivoted from their open, vertical positions, in which they are shown in FIG. 1, towards one another into their closed, horizontal positions.

Beneath the bomb bay door arrangement, there is provided a support plate 14 which, as will be more readily evident from the following description, defines a first position at which successive batches of the insulation batts are deposited.

The insulation batt support plate 14 is provided, at its rearmost end, with an upstanding wall 15 for retaining the batches of insulation batts on the upper surface of the insulation batt support plate 14 during longitudinal displacement of the latter for carrying the batches of insulation batts into a compression chamber indicated generally by reference numeral 16.

The compression chamber 16 is provided with an insulation batt support member in the form of a lifting fork having a plurality of parallel, horizontal bars 17 extending into the interior of the compression chamber 16 between a plurality of vertical, spaced bars 18, which form the rear wall of the compression chamber 16.

The lifting fork is mounted for horizontal and vertical displacement on a carriage 20 (FIG. 2), which is guided for vertical reciprocation at the exterior of the rear of the compression chamber 16.

More particularly, a vertically acting pneumatic piston and cylinder device having a cylinder 21 secured to the top of the compression chamber 16 and a piston rod 22 connected to the carriage 20 serves to move the carriage 20 vertically upwardly and downwardly.

On the carriage, there is provided a second pneumatic piston and cylinder device comprising a cylinder 23 secured to the carriage and having a piston rod 24 connected to the lifting fork for horizontally displacing the lifting fork to and fro relative to the carriage, and for thus moving the lifting fork into and out of the interior of the compression chamber 16.

At the lowermost position of the carriage 20, and with the piston rod 24 extended to displace the lifting fork into the interior of the compression chamber 16, the bars 17 of the lifting fork are disposed at a level below that of the insulation batt support plate 14.

A further piston and cylinder device (not shown) is provided for horizontally displacing the insulation batt support plate 14, and therewith the upstanding wall 15, into the compression chamber 16 and more particularly to a second position, which is located above the bars 17 when the carriage 20 is in its lowermost position, as mentioned above.

The upstanding wall 15 extends over only a portion of the width of the horizontal insulation batt support plate 14, and a batt retainer door or flap 25 is horizontally pivotable about a vertical pivot axis adjacent the front, left-hand corner of the compression chamber 16, as viewed in FIG. 1.

The width of the flap 25 is such that, when the flap 25 is pivoted into a closed position, in which it extends transversely across the horizontal path of travel of the insulation batt support plate 14 between the first and second positions, the upstanding wall 15 is not contacted or obstructed by the closed retainer flap 25.

For compressing the insulation batts in the compression chamber 16, the latter is provided with a compression ram plate 26, which is vertically displaceable to and fro within the interior of the compression chamber 16 by means of a piston and cylinder device 27.

At the bottom of the compression chamber 16, there is provided a compression space located at the top of a flat support surface 28, and a horizontally acting ram 29 is displaceable, by means of a piston cylinder device (not shown), along the surface 28 to a discharge opening formed in a wall 30 of the compression chamber.

This discharge opening communicates with a bagging snout 31 by means of which a bag can be fitted over the compressed insulation batts in known manner.

In order to adapt the bagging snout 31 to insulation batts of different widths, the bagging snout 31 is longitudinally divided into two separate, laterally relatively movable snout halves 32 and 33, which each have a U-shaped cross-section, the longitudinal edges of the snout half 32 fitting between those of the snout half 33.

The snout half 32 is fixed to the wall 30 of the compression chamber 16, and the snout half 33 is displaceable, transversely of the longitudinal axis of the snout 31, by means of piston and cylinder devices 34 mounted on the wall 30 and having their piston rods connected to a bar 35, which in turn is connected to the snout half 33.

The operation of the above-described apparatus will now be described with reference to FIGS. 3 to 14.

Figure 3:
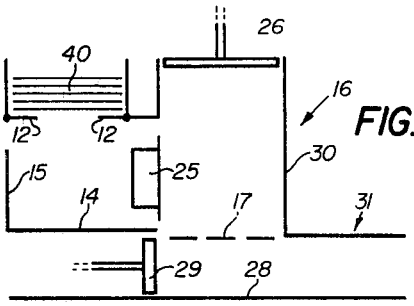
FIGS. 3 to 14 show diagrammatic views taken in longitudinal section through the apparatus of FIG. 1 and illustrating successive steps in the compression and packaging of insulation batts.

In the first step of the present insulation batt compression and packaging process, a plurality of insulation batts 40 are successively discharged from the conveyor 10 onto the bomb bay doors 12 with the latter in their closed, horizontal positions, as shown in FIG. 3. At this time, the insulation batt support plate 14 is disposed at the above-mentioned first position, which is located directly below the bomb bay doors 12; the retainer flap 25 is in its open position, i.e. it extends parallel to the horizontal path of movement of the insulation batt support plate 14; the vertically displaceable compression ram plate 26 is in its uppermost position in the compression chamber 16; the lifting fork has its horizontal bars 17 located in the above-mentioned second position and below the horizontal path of movement of the insulation batt support plate 14; and the horizontally acting ram 29 is in its retracted position.

Figure 4:
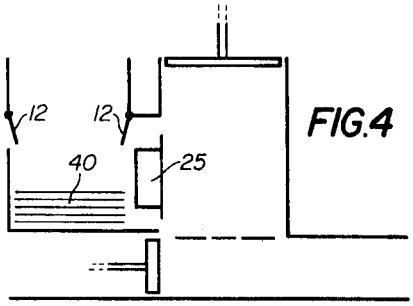
Figure 5:
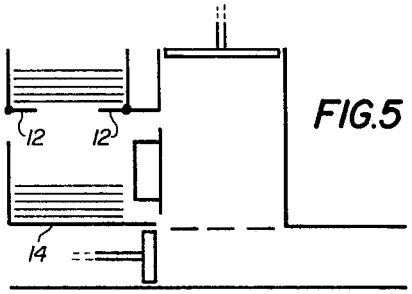
Figure 6:
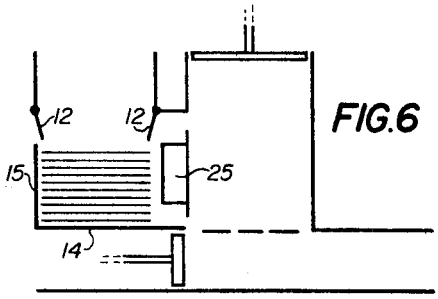

The bomb bay doors 12 are then pivoted downwardly into their open positions, as shown in FIG. 4, in which the bomd bay doors 12 are sufficiently spaced apart to allow the insulation batts to fall therebetween and to become deposited in a stack on the insulation batt support plate 14. The bomb bay doors 12 are then again closed, to allow a further plurality of the insulation batts to accumulate thereon, as shown in FIG. 5, and are then again opened to deposit this plurality of insulation batts onto those already stacked on the insulation batt support plate 14, as shown in FIG. 6.

Figure 7:
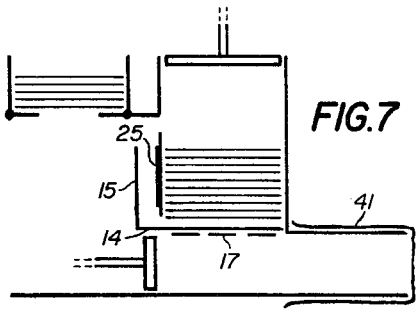

The batch of insulation batts which at this time has accumulated on the insulation batt support plate 14 is then displaced horizontally, by horizontal movement of the support plate 14, into the second position in the compression chamber 16, in which they are shown in FIG. 7. During this displacement of this first batch of insulation batts, the insulation batts are retained on the insulation batt support plate 14 by the upstanding wall 15 and, when they have reached the second position, the retainer flap 25 is pivoted about its vertical axis into its closed position, in which it is shown in FIG. 7 and in which it extends transversely of the path of movement of the insulation batt support plate 14.

Figure 8:
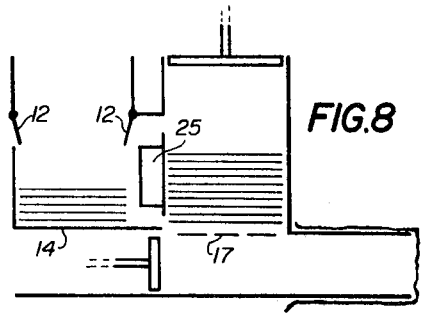

During subsequent return of the insulation batt support plate 14 and therewith its upstanding wall 15 from the second position to the first position, the closed flap 25 retains the first batch of insulation batts in the compression chamber so that they fall slightly onto the bars 17 of the lifting fork, and become positioned as shown in FIG. 8.

As also shown in FIG. 8, the bomb bay doors 12 have again opened to deposit in a stack on the insulation batt support plate 14 a plurality of insulation batts forming a first part of a second batch of the batts.

Figure 9:
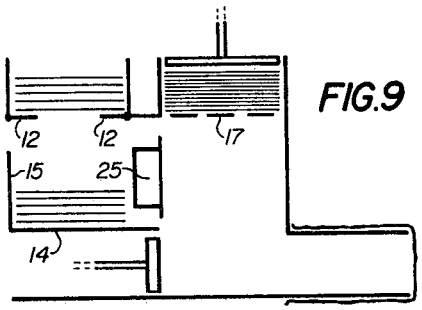

By means of the vertically acting piston and cylinder device 21, the carriage 20 is then raised, and thus the bars 17 of the lifting fork raise the first batch of insulation batts from the second position, in which they are shown in FIG. 8, to a third position, in which they are shown in FIG. 9, and in which they are disposed at the underside of the raised ram plate 26.

Figure 10:
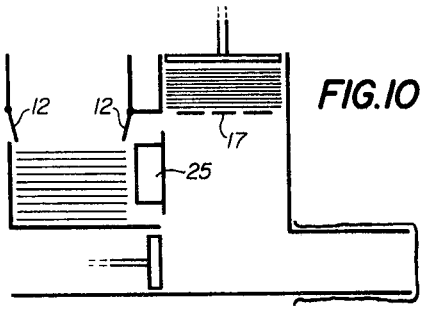
Figure 11:
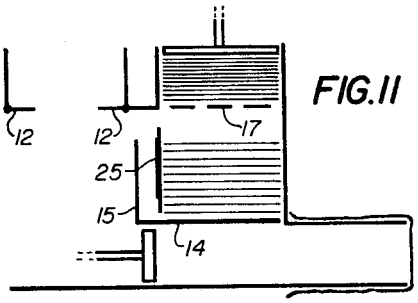

As shown in FIG. 10, the bomb bay doors 12 are then again opened to deposit further batts on the insulation batt support plate 14 and thus to complete the accumulation of a second batch of the batts on the insulation batt support plate 14, and the latter is then horizontally displaced once again to move this second batch into the second position, as shown in FIG. 11.

Figure 12:
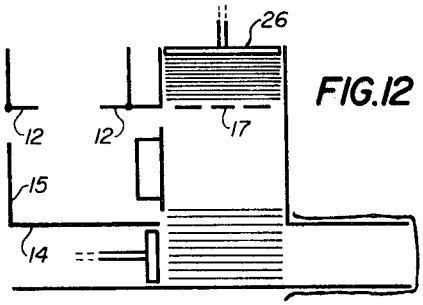
Figure 13:
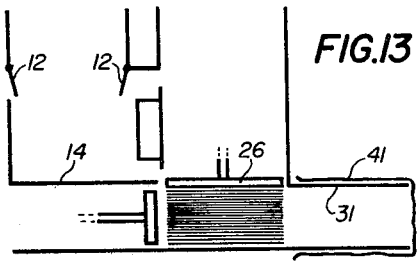

With the retainer flap 25 again in its closed position, the insulation batt support plate 14 is returned to its first position, which causes the second batch to fall into the compression space above the support surface 28, as shown in FIG. 12.

The piston and cylinder device 27 is then actuated to displace the compression ram plate 26 downwardly, and thereby to compress the first and second batches of insulation batts in the compression space, the cylinder 33 being operated to retract the bars 17 of the lifting fork from the compression chamber.

Figure 14:
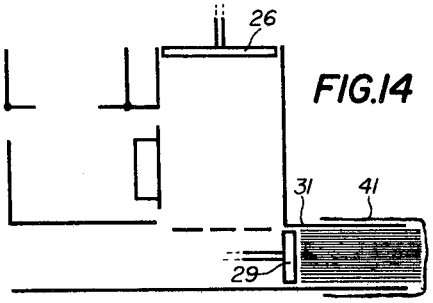

Finally, the horizontally acting ram 29 is displaced to the right, as viewed in FIG. 14, to discharge the compressed first and second batches of insulation batts through the bagging snout 31 and thus into a plastic bag 41, previously fitted over the outer end of the bagging snout 31.

The open mouth of the plastic bag 41 is then heat sealed around the insulation batts in known manner.

The above-described cycle of operations is, of course, repeated to compress and package further insulation batts delivered by the conveyor 10.

For convenience of illustration, the bomb bay doors 12 have been illustrated in FIGS. 3 to 14 as being pivotable about axes perpendicular to the planes of these figures, and it will be readily apparent that, with the apparatus as shown in FIGS. 1 and 2, the horizontal axes or pivotation of the bomb bay doors 12 are in fact parallel to these planes.

However, it will also be apparent to those skilled in the art that the bomb bay door arrangment and the conveyor as shown in FIG. 1 could be horizontally displaced through 90°, in which case the bomb bay door pivots would be as shown in FIGS. 3 to 14.

The above-described insulation batt compression and packaging apparatus has the advantage that the insulation batts delivered by the conveyor 10 can be compressed and discharged into the bag 41 without any manual handling of the insulation batts. The present apparatus thus avoids the expense and other disadvantages of manual handling of the insulation batts, and moreover is able to handle the batts at a sufficiently high rate to cope with the high rate of delivery of such batts from modern batt forming production lines.

Since a relatively small plurality of the batts are firstly collected on the closed bomb bay doors 12, and are then discharged together therefrom onto the underlying insulation batt support plate 14, they are required to drop through only a relatively small distance, which substantially reduces any risk of the insulation batts being disoriented and caught up as they drop onto the support plate 14.

We claim:

1. Apparatus for compressing and packaging articles, comprising:

means for receiving the articles in succession and depositing the articles in a first position in successive batches each comprising a stack of the articles;

a compression chamber;

means for displacing the batches in succession from said first position to a second position in said compression chamber;

means for displacing a first one of the batches from the second position to a third position in said compression chamber to allow the displacement of the next succeeding batch from the first position to the second position;

means for compressing the first batch and the next succeeding batch together in said compression chamber; and means for applying to the compressed batches retaining means for retaining the batches in their compressed condition.

2. Apparatus as claimed in claim 1, wherein said receiving means comprise a pair of retainer members pivotable about parallel horizontal axes between closed positions, in which said retainers support the articles thereon, and open positions, in which said retainers are spaced sufficiently to allow the articles to fall therebetween under gravity to the first position.

3. Apparatus as claimed in claim 1, wherein said means for displacing the batches from the first position to the second position comprise a batch support and means for reciprocating said batch support between the first and second positions.

4. Apparatus as claimed in claim 3, further comprising a batch retainer movable to and from a retaining position in which said batch retainer extends at least partly across the path of movement of said batch support for preventing return of the articles with said batch support from the second position to the first position.

5. Apparatus as claimed in claim 4, wherein said compression chamber includes a compression space beneath the second position, said compressing means being movable downwardly to compress the batches in said compression chamber into said compression space.

6. Apparatus as claimed in claim 5, further comprising horizontal ram means displacing said compressed batches from said compression space.

7. Apparatus as claimed in claim 6, wherein said applying means comprise a bagging snout communicating with said compression space.

8. Apparatus as claimed in claim 1, wherein said applying means comprise a bagging snout, said snout comprising two laterally relatively movable sides, and means for displacing said sides towards and away from each other to adapt said snout to articles of different sizes.

9. Apparatus as claimed in claim 1, wherein said means for displacing the first batch in the compression chamber comprise a support member, first power means for displacing said support member from said second position to said third position within said compression chamber, and second power means for displacing said support member into and from said compression chamber.

10. Apparatus as claimed in claim 9, further comprising a support carriage vertically displaceable at the exterior of said compression chamber, said support member being horizontally movably mounted on said support carriage, said first power means comprising means for vertically reciprocating said support carriage adjacent said compression chamber and said second power means comprising means for horizontally reciprocating said support member relative to said support carriage for extending and retracting said support members into and from said compression chamber.

11. Apparatus as claimed in claim 10, wherein said support member comprises a plurality of spaced parallel horizontal bars movable between spaced parallel vertical bars forming one side of said compression chamber.

12. Apparatus as claimed in claim 1, further comprising upwardly inclined conveyor means for delivering the articles in succession to said receiving means.

13. Apparatus as claimed in claim 1, wherein said third position is located above said second position and said displacing means comprise means for lifting the first batch.

14. Apparatus for compressing and packaging batts of insulation material, comprising:

upwardly inclined conveyor means for delivery of the batts in succession from the upper end of said conveyor means;

means for receiving and temporarily retaining the batts as the batts drop in succession from the upper end of said conveyor means and for depositing the batts in a first position in successive batches each comprising a stack of the batts;

a batt compression chamber;

means for displacing the batches in succession from said first positon to a second position located in said compression chamber;

means for upwardly displacing a first one of the batches from said second position to a third position located above said second position to allow the displacement of the next succeeding batch from the first position to the second position;

means for pressing the first batch downwardly onto the next succeeding batch and thereby compressing both said batches together in said compression chamber; and means for applying a covering to the said compressed batches for retaining the batches in their compressed condition.

15. Apparatus as claimed in claim 14, wherein said receiving and retaining means comprise retainer members movable between first positions, in which said retainer members extend between the upper end of said conveyor means and the first position for retaining said batts above said first position, and second positions, in which said retainers are spaced sufficiently to allow the batts to fall therebetween under gravity into the first position.

16. Apparatus as claimed in claim 15, wherein said means for displacing the batches comprises a horizontally reciprocable vertical pusher member for pressing against the batts.

17. Apparatus as claimed in claim 16, wherein said means for displacing the batches further comprises a horizontal batch support movable with said pusher member.

18. Apparatus as claimed in claim 16, wherein said means for upwardly displacing the first batch comprises a batch support member, means for vertically reciprocating said batch support member between the levels of said second and third positions and means for horizontally reciprocating said batch support member between an extended position within said compression chamber and a retracted position outside said compression chamber.

* * * * *